US010945542B2

(12) United States Patent
Muthanandam

(10) Patent No.: US 10,945,542 B2
(45) Date of Patent: Mar. 16, 2021

(54) CENTRAL ACCESS DUVET COVER WITH COVERABLE OPENING

(71) Applicant: Standard Textile Co., Inc., Cincinnati, OH (US)

(72) Inventor: Saravan Muthanandam, Mason, OH (US)

(73) Assignee: Standard Textile Co., Inc., Cincinnati, OH (US)

( * ) Notice: Subject to any disclaimer, the term of this patent is extended or adjusted under 35 U.S.C. 154(b) by 27 days.

(21) Appl. No.: 16/402,414

(22) Filed: May 3, 2019

(65) Prior Publication Data

US 2019/0343306 A1 Nov. 14, 2019

Related U.S. Application Data

(60) Provisional application No. 62/670,128, filed on May 11, 2018.

(51) Int. Cl.
*A47G 9/02* (2006.01)

(52) U.S. Cl.
CPC .... *A47G 9/0261* (2013.01); *A47G 2009/0276* (2013.01)

(58) Field of Classification Search
CPC ..... A47G 9/0261; A47G 2009/0276; A47G 9/02; A47G 9/0207; A47G 2009/0269
See application file for complete search history.

(56) References Cited

U.S. PATENT DOCUMENTS

| | | | |
|---|---|---|---|
| 1,347,642 | A | 7/1920 | McNatt |
| 2,821,723 | A | 2/1958 | Gluck |
| 3,638,334 | A | 2/1972 | Malikowski |
| 3,754,692 | A | 8/1973 | Sanders |
| 4,903,361 | A | 2/1990 | Tang |
| 5,199,121 | A | 4/1993 | Ayne |
| 5,299,333 | A | 4/1994 | Pedersen et al. |
| 5,655,236 | A | 8/1997 | Murray |
| 5,720,058 | A | 2/1998 | Hollander et al. |

(Continued)

FOREIGN PATENT DOCUMENTS

| | | | |
|---|---|---|---|
| AU | 2015101709 | A4 | 1/2016 |
| DE | 3738397 | A1 | 7/1988 |

(Continued)

*Primary Examiner* — Robert G Santos
*Assistant Examiner* — George Sun
(74) *Attorney, Agent, or Firm* — Wood Herron & Evans LLP

(57) ABSTRACT

A duvet cover includes first and second fabric layers with a pocket defined between the layers, and which is configured to have an opening defining an entrance to the pocket that can receive a separate fill layer, defined by a blanket or comforter. At least a section of one of the fabric layers defining a flap configured to engage with a corresponding section of the duvet cover and cover the opening via fastening elements. At least some of the fastening elements can be color-coded to identify the size of the bed for which the duvet cover is to cover. One of the fabric layers and the fill layer can include fastening elements that engage one another to secure the fill layer in position within the cover assembly. The duvet cover hides the appearance of the fill layer in the pocket and covers the opening through which the fill layer is received.

30 Claims, 9 Drawing Sheets

(56) References Cited

U.S. PATENT DOCUMENTS

| | | | | |
|---|---|---|---|---|
| 6,032,308 | A | 3/2000 | Chuang | |
| 6,230,341 | B1 | 5/2001 | Dudley | |
| 6,637,054 | B2 | 10/2003 | Chuang | |
| 6,971,128 | B1 * | 12/2005 | McGrath | A47G 9/0253 5/482 |
| 7,013,509 | B2 | 3/2006 | Hickman | |
| 7,017,207 | B2 | 3/2006 | Lauderman | |
| 7,168,110 | B2 * | 1/2007 | Girard | A61G 1/01 5/627 |
| 7,624,460 | B2 | 12/2009 | Maimone et al. | |
| 3,011,038 | A1 | 9/2011 | Balasundharam | |
| 8,347,435 | B2 | 1/2013 | Yu | |
| 8,438,679 | B2 | 5/2013 | Wootten, Jr. | |
| 3,458,832 | A1 | 6/2013 | Krishna | |
| 3,549,682 | A1 | 10/2013 | Low | |
| 3,689,375 | A1 | 4/2014 | Stinchcomb | |
| 9,089,228 | B2 | 7/2015 | Shattuck et al. | |
| 9,095,230 | B2 | 8/2015 | Shattuck et al. | |
| 9,549,625 | B1 | 1/2017 | Wilkinson et al. | |
| 10,285,517 | B2 | 5/2019 | Heiman et al. | |
| 10,413,099 | B2 | 9/2019 | Stewart | |
| 2004/0016055 | A1 * | 1/2004 | Lamy | A47G 9/02 5/485 |
| 2004/0068795 | A1 | 4/2004 | Hollander | |
| 2005/0144721 | A1 * | 7/2005 | Linnane | A47G 9/0261 5/501 |
| 2006/0037136 | A1 * | 2/2006 | Weedling | G09F 3/00 5/81.1 HS |
| 2008/0189857 | A1 | 8/2008 | Delfs | |
| 2009/0205134 | A1 * | 8/2009 | Wootten, Jr. | A47G 9/0246 5/488 |
| 2010/0050341 | A1 * | 3/2010 | Tepper | A47G 9/0261 5/488 |
| 2011/0023234 | A1 | 2/2011 | Bolish et al. | |
| 2011/0035881 | A1 | 2/2011 | Cohen | |
| 2012/0060283 | A1 * | 3/2012 | Campasano | A47G 9/0238 5/495 |
| 2012/0297541 | A1 | 11/2012 | Brown | |
| 2013/0117933 | A1 * | 5/2013 | Mickle | A47G 9/02 5/413 R |
| 2014/0157575 | A1 | 6/2014 | Stinchcomb | |
| 2015/0082540 | A1 * | 3/2015 | Sirok | A47G 9/0261 5/502 |
| 2015/0157147 | A1 | 6/2015 | Haraszta | |
| 2016/0022062 | A1 | 1/2016 | Carr | |
| 2016/0081405 | A1 | 3/2016 | Gubitosa et al. | |
| 2016/0338513 | A1 | 11/2016 | Mittal et al. | |
| 2017/0056265 | A1 | 3/2017 | Duck | |
| 2017/0071368 | A1 | 3/2017 | Pelaez | |
| 2017/0127855 | A1 * | 5/2017 | Wootten, Jr. | A47G 9/0261 |
| 2018/0027998 | A1 * | 2/2018 | Heiman | A47G 9/0207 |
| 2018/0146805 | A1 * | 5/2018 | Stinchcomb | A47G 9/04 |
| 2018/0206659 | A1 * | 7/2018 | Savage | A47G 9/0261 |
| 2018/0255946 | A1 | 9/2018 | Stewart et al. | |
| 2019/0099017 | A1 * | 4/2019 | Goldberg | A47G 9/0261 |
| 2019/0223630 | A1 * | 7/2019 | Phan | A47G 9/0261 |

FOREIGN PATENT DOCUMENTS

| | | | | |
|---|---|---|---|---|
| DE | 202005002388 | U1 | 7/2005 | |
| EP | 3117745 | A1 | 1/2017 | |
| FR | 2868274 | A1 | 10/2005 | |
| GB | 2272639 | A | 5/1994 | |
| GB | 2389523 | A | 12/2003 | |
| GB | 2415371 | A | 12/2005 | |
| GB | 2481318 | A * | 6/2011 | A47G 9/02 |
| GB | 2500593 | A | 10/2013 | |
| JP | 2002325668 | A | 11/2002 | |
| JP | 2003116693 | A | 4/2003 | |
| WO | 2010022446 | A1 | 3/2010 | |
| WO | 2014128695 | A1 | 8/2014 | |

* cited by examiner

CENTRAL ACCESS DUVET COVER WITH COVERABLE OPENING

TECHNICAL FIELD

The present invention relates generally to linens used with bedding and, more specifically, to duvet covers used with bedding in various contexts.

BACKGROUND

Blankets and comforters, such as down comforters, provide an extra layer of comfort and warmth to those who choose to use them while sleeping. For example, a down comforter provides more warmth and comfort as compared to sleeping under only a top sheet of a sheet set applied to a bed. However, because of the bulk/size of comforters and blankets, these bedding elements can be very difficult to properly clean. In order to diminish the need for direct cleaning and extend the life thereof, these blankets and comforters are often covered with (and/or inserted within) what is known as a duvet cover. The duvet cover protects the blanket or comforter while, at the same time, contributes an aesthetically appealing element to the bed when positioned atop the bed. When used in place of a top sheet, as many persons choose to do, the duvet cover is in regular contact with the human body and therefore should be cleaned on a regular basis. This cleaning typically necessitates removal of the duvet cover from the blanket or comforter.

One conventional version of a duvet cover includes top and bottom panels of fabric material, which are generally permanently coupled together, such as by stitching, along a first portion of the periphery thereof, and which define an opening along a second portion of the periphery thereof. This opening may be permanently open, or in some embodiments, may be selectively closed by a connection mechanism such as a zipper. The blanket or comforter, or some other similar type of fill layer, is pushed through the opening to be sandwiched between the top and bottom panels in a similar fashion as inserting a pillow into a pillowcase. However, unlike a pillow, the fill layer is substantially large and capable of bunching up or folding over itself when being inserted into the duvet cover through the opening. This can cause significant difficulties and delays when an operator tries to properly position the fill layer within the duvet cover, or when removing the fill layer from the duvet cover. These deficiencies are exacerbated in commercial contexts such as hotels and hospitals, where bedding materials can require washing every day, in some circumstances.

Rather than having a peripheral opening to accommodate a fill layer, certain duvet covers can provide a widthwise opening along a bottom panel in between head and foot ends of the duvet cover. Again, a blanket or comforter, or some other similar type of fill layer, can be pushed through the opening to be sandwiched between a top and bottom panel of the duvet cover. For aesthetic purposes, the opening side is typically oriented downward when situated atop a bed and used in this orientation by a user, such as while sleeping. With these types of duvet covers, a user's appendage(s), such as hand(s)/finger(s), arm(s), foot/feet, or leg(s), can become entangled with or caught in the opening during use, which can be uncomfortable and provide a general annoyance to the user and, consequently, can interfere with a good night's sleep.

Furthermore, in both commercial contexts and residential/home contexts, bedding materials are often mixed together and cleaned for various sizes of beds (e.g., twin, full, queen, king, and other sizes). Some of these sizes are sufficiently similar that it can be difficult to identify the size of fill layers and duvet covers, and thereby match corresponding pairs of these items. Significant time and energy is expended identifying and sorting these bedding materials based on the size thereof. For example, if a fill layer and a duvet cover of different size are matched together during sorting of bedding materials, an operator will waste significant time trying to assemble these differently-sized components together before realizing that re-sorting is necessary.

Conventional duvet covers do not find as significant of use as would be expected in places like hotels, because of complications resulting from the potential need to remove and replace a duvet cover on a plurality of beds every single day of operation. Additionally, the conventional designs for duvet covers are fairly labor-intensive to assemble and thus come with added costs. The management of various sizes of duvet covers for various sizes of beds also adds to the difficulty and time needed to clean a mixture of bedding materials on a regular basis. Accordingly, bedding options and decorative options that can be offered are often reduced in these settings. Similar and other deficiencies, such as noted above, can also reduce the use of duvet covers in the residential/home context.

It would be desirable, therefore, to provide a new duvet cover, such as for use with a duvet cover system, that addresses one or more of the aforementioned drawbacks of conventional designs of duvet covers.

SUMMARY

The present invention relates to linens used with bedding and, more specifically, to duvet covers used with bedding in various contexts.

In one embodiment, a duvet cover is provided that includes a first fabric layer and a second fabric layer configured to substantially enclose a pocket between the fabric layers. The first fabric layer includes a head section and foot section having an opening therebetween defining an entrance to the pocket and further includes an overlap section that defines a flap that cooperates with one of the head or foot section adjacent the opening and extends in a direction away therefrom. The pocket is configured to receive a fill layer and the overlap section is configured to cover the opening and overlap with the other of the head or foot section. In one example, the first fabric layer is secured to the second fabric layer along a plurality of side edges to provide a closed periphery, with the foot and head sections of the first fabric layer extending over different portions of the duvet cover to meet one another at a junction, which extends along a width of the duvet cover and between an opposing pair of the side edges. In addition, the pocket is defined between the first and second fabric layers and within the closed periphery, with the pocket sized to receive the fill layer in the form of a blanket or comforter to enclose the fill layer within the duvet cover. The opening is formed between the foot and head sections of the first fabric layer at the junction to provide access to the pocket from outside the duvet cover. The opening extends along a majority of the width of the cover assembly to enable insertion and removal of the fill layer into and out of the pocket through the opening.

In another embodiment, a duvet cover system is provided that includes a duvet cover having a first fabric layer and a second fabric layer that are configured to substantially enclose a pocket between the fabric layers. The first fabric layer includes a head section and foot section having an opening therebetween defining an entrance to the pocket. The first fabric layer further includes an overlap section that defines a flap that cooperates with one of the head or foot section adjacent the opening and extends in a direction away therefrom. The duvet cover system further has a fill layer, which includes at least one of a blanket or a comforter, and which is configured for insertion within the pocket of the duvet cover, wherein the overlap section covers the opening and overlaps with the other of the head or foot section to hide the opening and fill layer when the duvet cover system is assembled. In one example, the duvet cover system further includes a plurality of fastening elements that are located adjacent corner portions of the other of the head or foot section, which are configured to be engaged with retention slots on the overlap section when the overlap section covers the opening and overlaps with the other of the head or foot section.

In another embodiment, a method for covering a bed with a duvet cover system including a fill layer that is defined by at least one of a blanket or a comforter is provided that includes inserting the fill layer through an opening defined in a duvet cover having a first fabric layer and a second fabric layer configured to substantially enclose a pocket between the fabric layers. The first fabric layer includes a head section and foot section having the opening therebetween defining an entrance to the pocket. The first fabric layer further includes an overlap section that defines a flap that cooperates with one of the head or foot section adjacent the opening and extends in a direction away therefrom, wherein the pocket is configured to receive the fill layer and the overlap section is configured to cover the opening and overlap with the other of the head or foot section. The method further includes placing the fill layer into the pocket defined between the first and second fabric layers so as to retain the fill layer between the top and bottom fabric layers of the cover duvet. Next, a plurality of fastening elements located adjacent corner portions of the fill layer and adjacent corner portions of the other of the head or foot section are coupled with retention slots located at the corner portions of the foot and head sections and at the overlap section, respectively, to hold the fill layer in a desired position within the pocket of the duvet cover system and to hide the opening and fill layer. The method further includes laying the duvet cover system onto the bed with one of the first or second fabric layers facing upwardly with the fill layer remaining hidden from view and wherein the duvet cover is configured to be removed for cleaning separate from the fill layer.

BRIEF DESCRIPTION OF THE DRAWINGS

The accompanying drawings, which are incorporated in and constitute a part of this specification, illustrate embodiments of the invention and, with a detailed description of the embodiments given below, serve to explain the principles of the invention.

DETAILED DESCRIPTION

FIGS. 1 through 9C show a central access duvet cover 12 for use in a central access duvet system 10 in accordance with one embodiment of the invention. Advantageously, the central access duvet cover 12, such as when used in the system 10, can eliminate the need for a specific side of the duvet cover 12 to be always oriented face up atop a bed and can further eliminate concerns that the cover 12 itself may interfere with a user's sleep. In addition, the components defining the central access duvet cover system 10 can be secured in position relative to one another with a plurality of fastening elements to prevent misalignment, shifting, bunching up and the like. At least some of these fastening elements may be color-coded in accordance with the size of the bed upon which the central access duvet cover 12 is to be used, thereby enabling easy identification of matching sets of components following cleaning of the central access duvet cover 12. Moreover, each standard size of bed (e.g., twin, full, queen, king) uses fastening elements of a specific color, such as red for king, blue for queen, etc., and this arrangement helps a user quickly identify and install a proper-sized embodiment of the central access duvet cover 12, such as when used in the system 10, on a bed of one of the standard sizes. To that end, the central access duvet cover 12 of this invention significantly can reduce the management work needed to clean, sort, and replace various sizes of duvet materials on a plurality of beds.

Use of certain descriptive terms herein, such as top, bottom, head, foot, side, upwardly, downwardly, horizontal, and/or vertical, for example, as it pertains to/describes the duvet cover 12, the system 10, and their components, are from the viewpoint of when the duvet cover and system 10 are laid out on a bed 30, unless otherwise noted. It should also be understood that the views of FIGS. 3-9C show the duvet cover 12 and system 10 in a reversed orientation from its likely end use on the bed 30, e.g., with a bottom of a first fabric layer 14 facing upwardly to show additional details of that fabric layer 14. Yet, it should still be appreciated that the duvet cover 12 and system 10 can be utilized in the orientation as shown in these Figures.

Figure 1:
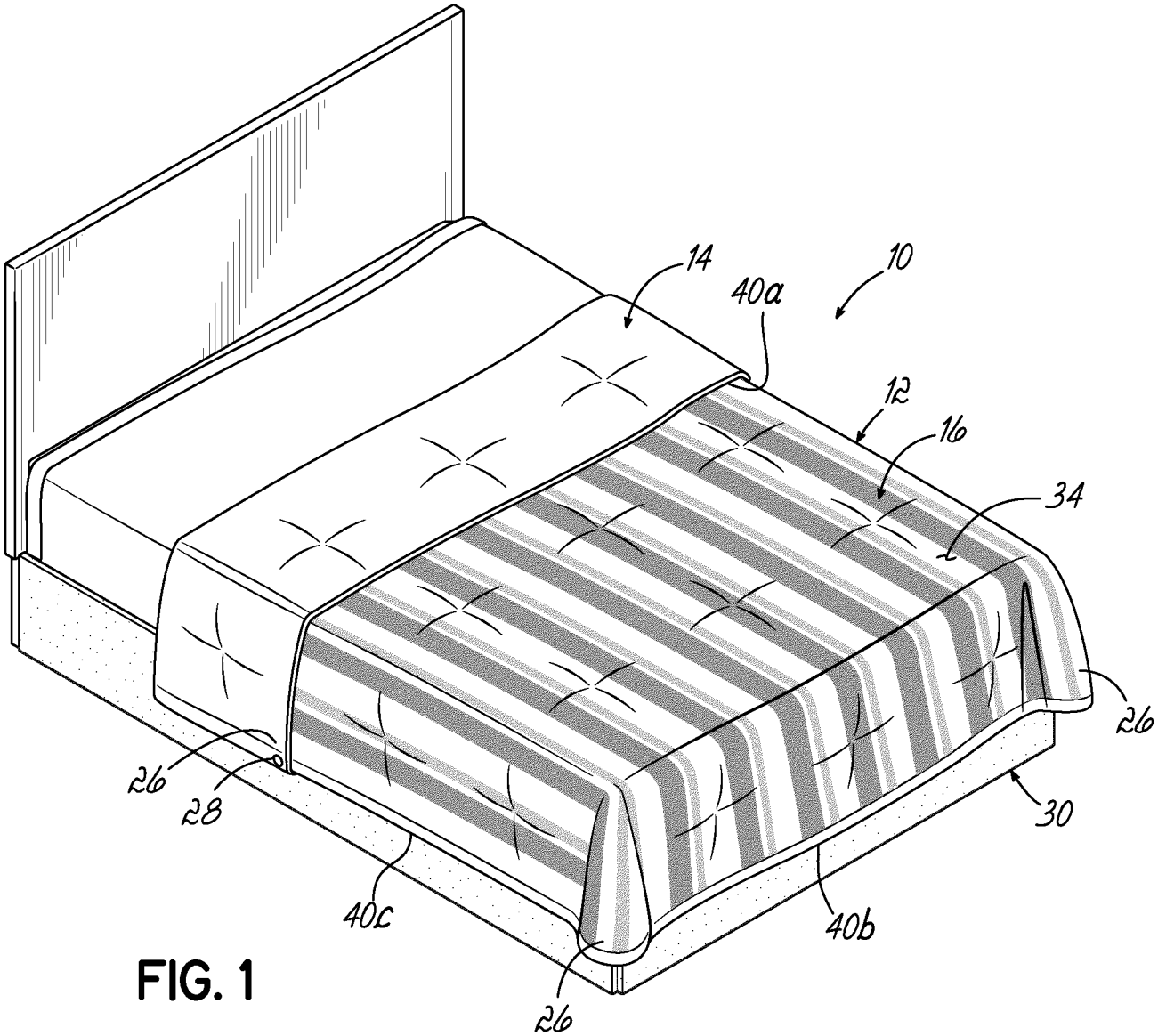
FIG. 1 is a top perspective view of a central access duvet cover for use in a central access duvet system, in accordance with one embodiment of the invention, with the system shown in a fully assembled state combining the duvet cover and a fill layer while spread over a bed.
Figure 2:
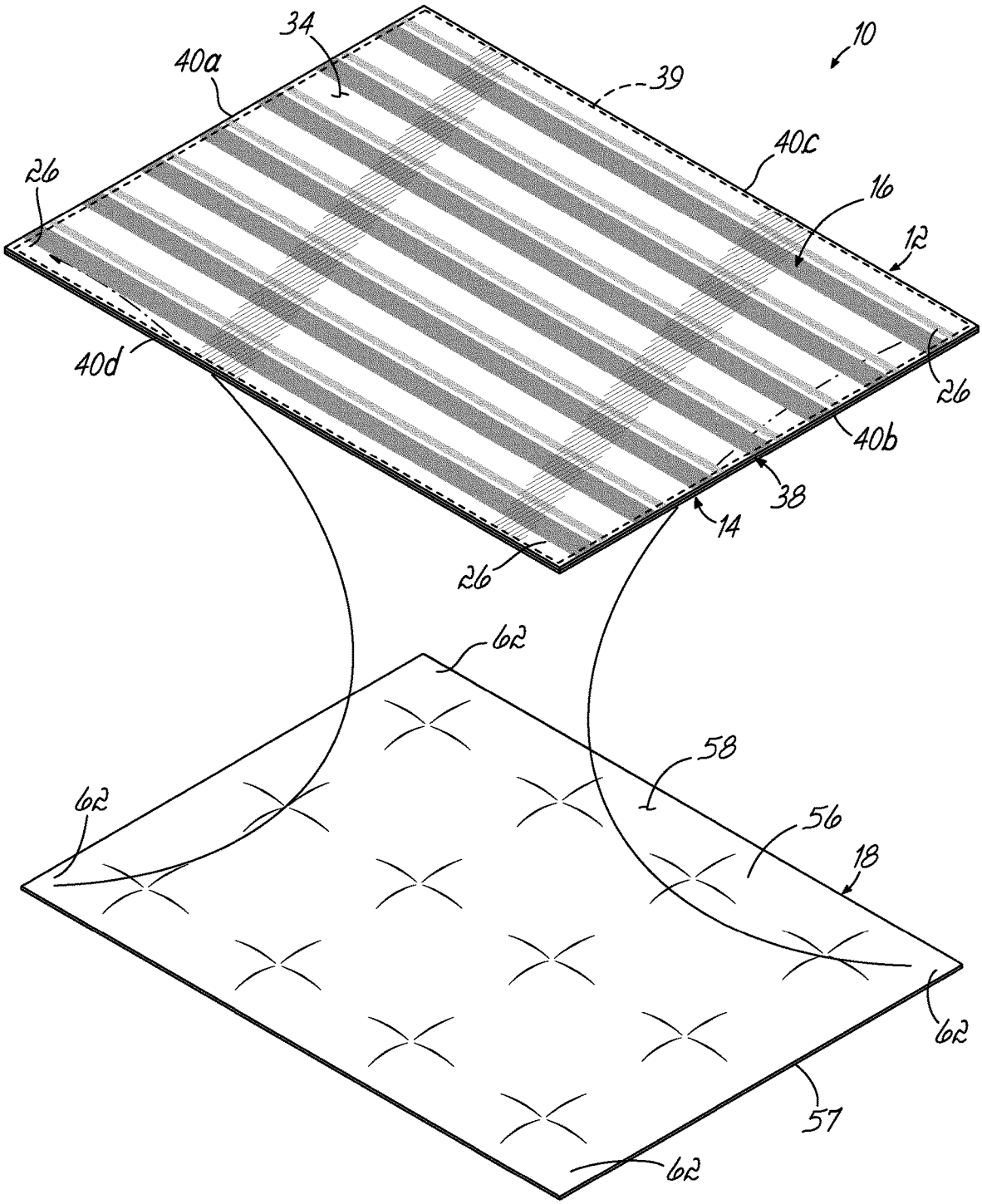
FIG. 2 is a top perspective view of the central access duvet cover for use in the central access duvet system of FIG. 1, with the fill layer removed from a pocket defined within the duvet cover to provide an exploded view.
Figure 3:
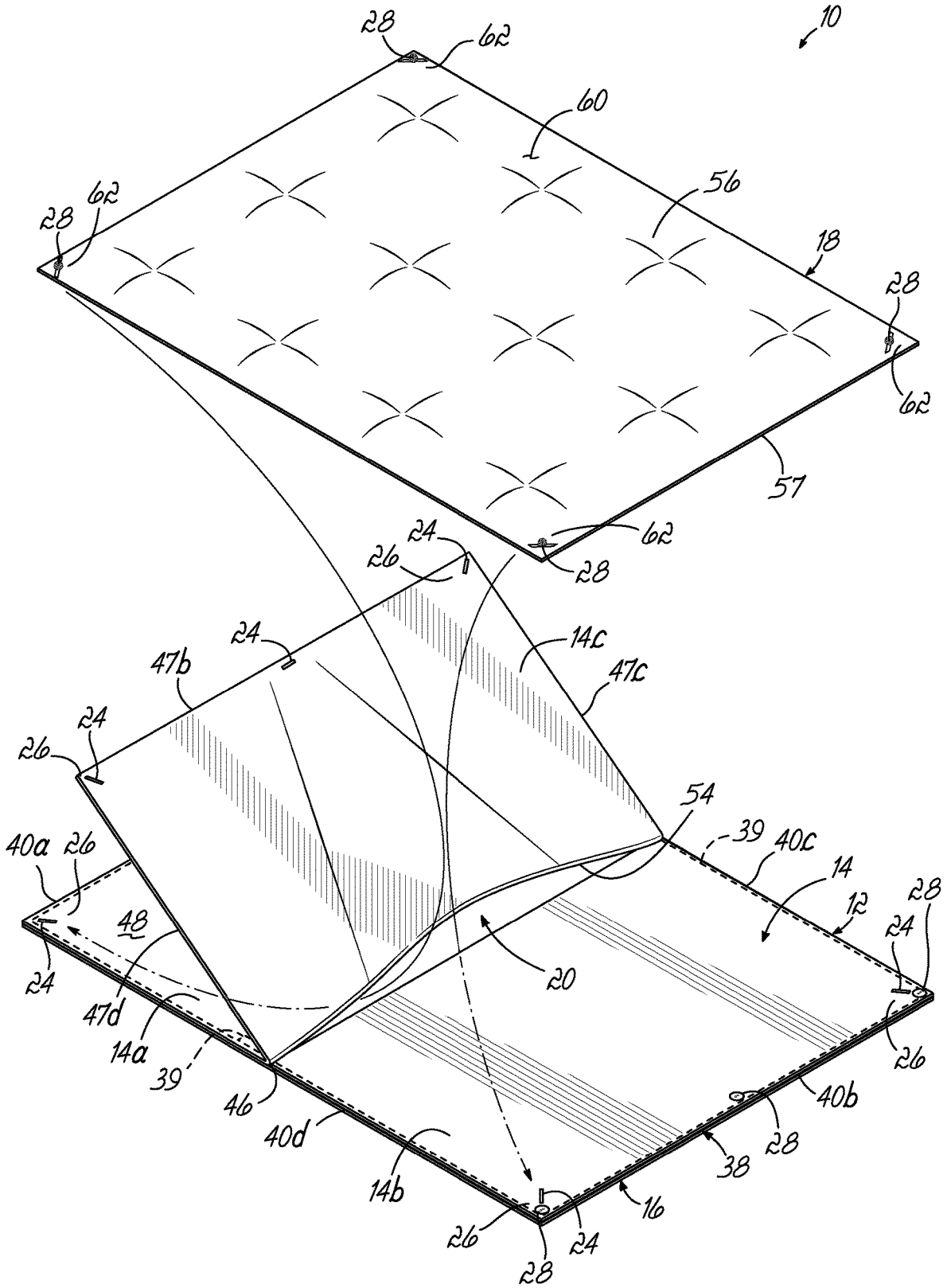
FIG. 3 is a bottom perspective view of the central access duvet cover for use in the central access duvet system of FIG. 1, with the fill layer removed from a pocket defined within the duvet cover to provide an exploded view, with this view showing further details of an opening and a foot section, head section, and an overlap section of the first fabric layer of the duvet cover.
Figure 4:
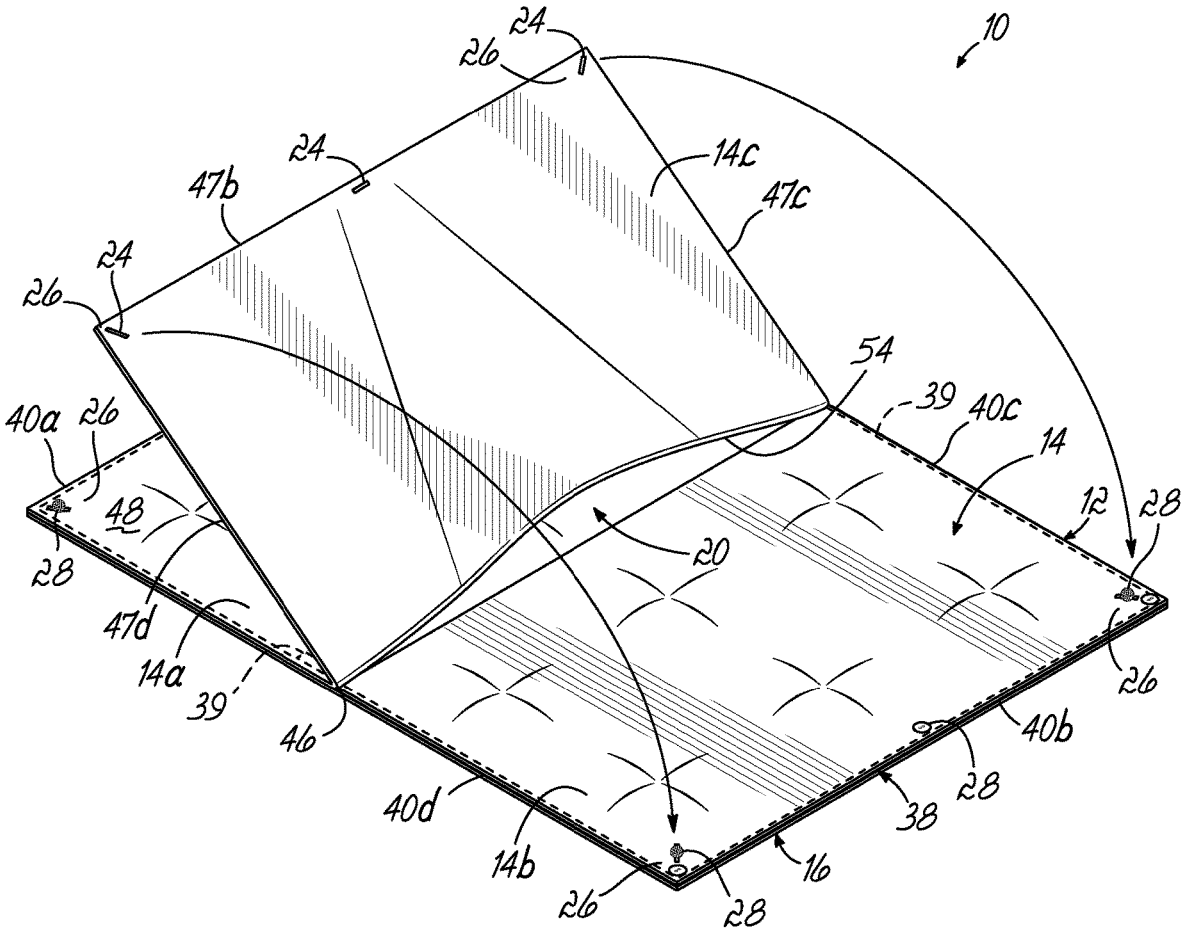
FIG. 4 is a bottom perspective view of the central access duvet cover for use in the central access duvet system of FIG. 1, with the fill layer inserted into the pocket of the duvet cover with a plurality of fastening elements on the fill layer engaged with retention slots at corner portions of the head section and foot section of the duvet cover and the overlap section ready for engagement with a plurality of fastening elements on the foot section.
Figure 5:
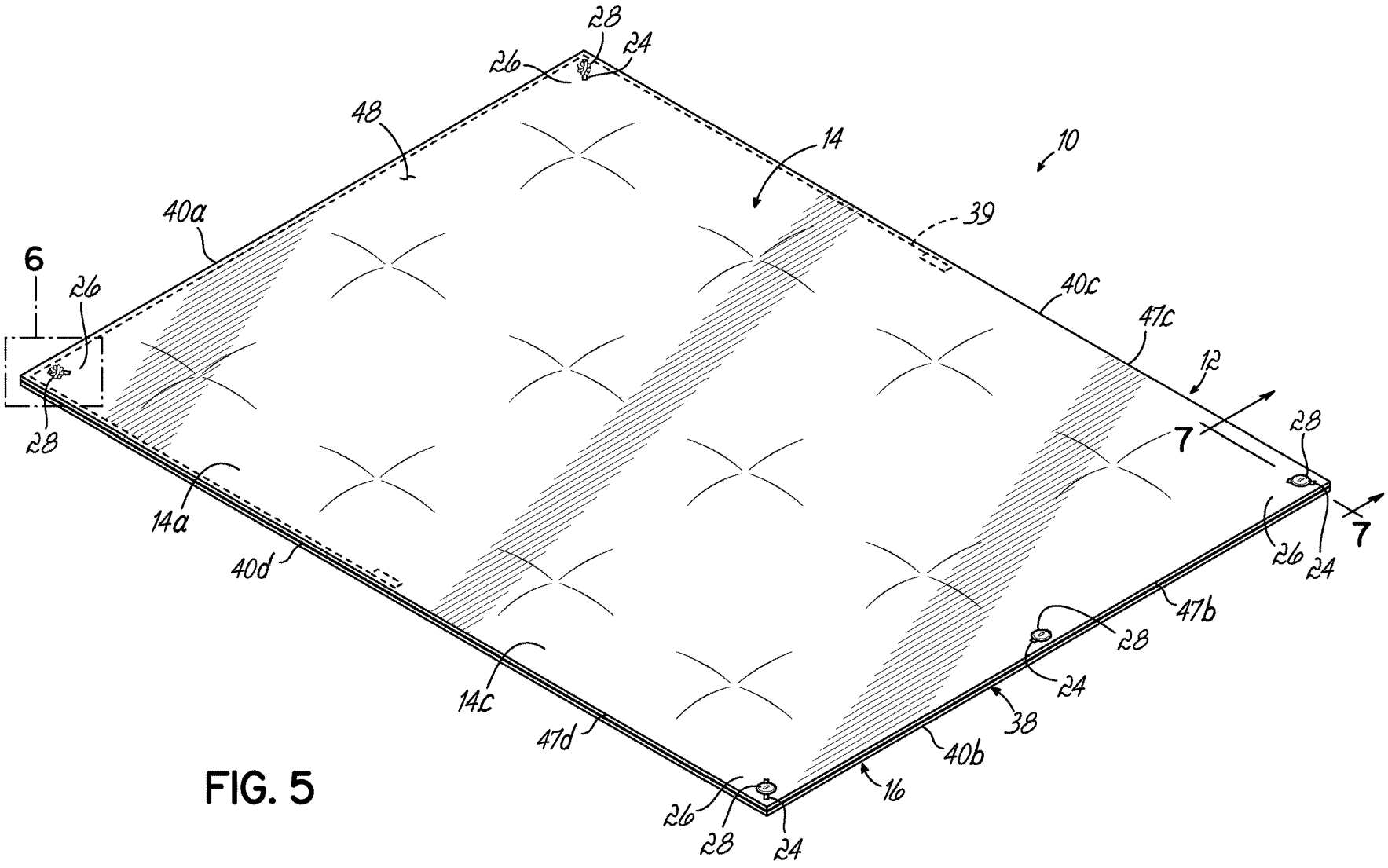
FIG. 5 is a bottom perspective view of the central access duvet cover for use in the central access duvet system of FIG. 1, with the system laid out in a completely horizontal orientation, and both the fill layer and overlap section assembled and fastened.

With reference to FIGS. 1 through 7, one embodiment of the central access duvet cover 12 for use in system 10 is shown in further detail. Here, the duvet cover 12 can be provided in system 10, with the duvet cover 12 being defined by a first fabric layer 14, which includes a foot section 14*a*, a head section 14*b*, and an overlap section 14*c*, and a second fabric layer 16, where the first fabric layer 14 is partly multi-layered when fully assembled, as further explained below. The fabric layers 14, 16 can be assembled to enclose and retain a fill layer 18 (defined by a blanket or a comforter) and to cover an opening 20 that receives the fill layer 18 to thereby simulate the performance, functionality, and general external appearance of a conventional duvet cover. Advantageously, the duvet cover 12 is configured for quick and easy assembly/disassembly with the fill layer 18. To this end, as best shown in FIGS. 3 and 4, the system 10 has the opening 20 situated between the foot section 14*a* and head section 14*b* and extending across a majority of the width of the duvet cover 12, while also being centrally located. The opening 20 may be easily accessed when the overlap section 14*c* is in an unfastened and pulled back position. The sizing and positioning of the opening 20 makes it easy to insert or remove a full-size blanket or comforter into a pocket 22 defined between the fabric layers 14, 16 of the duvet cover 12, particularly compared to conventional duvet covers with end openings. And as indicated above the ability to cover the opening 20 with the overlap section 14*c* eliminates concerns that the opening 20 itself may interfere with a user's sleep and also can reduce orientation concerns for the system 10. Moreover, as best shown in FIGS. 3-5, the system 10 of this embodiment also includes a plurality of retention slots 24 in the form of buttonholes located at corner portions 26 of the head section 14*a*, foot section 14*b*, and overlap section 14*c* of the duvet cover 12, with certain retention slots 24 configured to engage with corresponding fastening elements 28 located on the fill layer 18 and other retention slots configured to engage with fastening elements 28 located on the foot section 14*b*, all of which is further discussed in greater detail below. The fill layer 18 and the opening 16 remain substantially hidden from view when the system 10 is laid out on the bed 30, thereby simulating the desirable appearance of a conventional duvet cover, while overcoming the various disadvantages in assembly, and use of such conventional designs as set forth above. Furthermore, it will be understood that the fill layer 18 may be considered part of the system 10 in some embodiments, and a separate component in other embodiments where it is desired to provide the duvet cover 12 as a separate element from a pre-existing blanket or comforter.

With specific reference now to FIGS. 1 through 5, the duvet cover 12 for use in system 10 is illustrated and described in further detail in accordance with this embodiment. To that end, the second fabric layer 16 is shown as being defined by a rectangular sheet of fabric that is secured to the first fabric layer 14 along a plurality of side edges to define a closed periphery 38 of the duvet cover 12. For example, the second fabric layer 16 and the first fabric layer 14 may be stitched together (shown schematically by sew lines 39 in FIGS. 2 and 3) along the plurality of side edges. In the illustrated embodiment, the plurality of side edges defined by the duvet cover 12 includes a head end edge 40*a*, a foot end edge 40*b*, and first and second side edges 40*c*, 40*d* extending between the head and foot end edges 40*a*, 40*b*. As will be readily understood from FIG. 1, the head end edge 40*a* is configured to extend along a head end of bed 30 when the duvet cover 12 is placed on the bed 30, while the foot end edge 40*b* is configured to extend along a foot end of the bed 30 in the same circumstance. A portion of the duvet cover 12, such as when used in system 10, is typically folded down at the head end edge 40*a* as shown in FIG. 1, to provide space for persons to enter the bed 30 and to provide space for pillows. As shown in this embodiment and most clearly at FIG. 1, the top side 34 of the second fabric layer 16 may include a decorative pattern that adds a desirable or specific aesthetic look when the system 10 covers the bed 30, and a bottom side 36 (See FIG. 7) opposite the top side 34. The decorative pattern may be applied to the second fabric layer 16 by any known method, including dyeing, printing, and the like. Furthermore, the decorative pattern may define any color and sequence as desired by the end user of the duvet cover 12.

The first fabric layer 14 and the second fabric layer 16 are generally parallel to one another when the duvet cover 12 is assembled as shown in these views. The first fabric layer 14 is configured to be the bottom of the duvet cover 12 when placed atop the bed 30, but this orientation may be reversed by a user in other embodiments without departing from the scope of the invention. That is, a user may desire that the first fabric layer 14 be the top of the duvet cover 12 when placed atop the bed 30. The first fabric layer 14 includes one or more generally rectangular sheet(s) of fabric. To that end, the first fabric layer 14 of the embodiment shown in these Figures has a head section 14*a* and a foot section 14*b* that extend over different portions of the duvet cover 12. In this regard, the head section 14*a* is shown to extend from the head end edge 40*a* and along about half of the length of the opposing pair of side edges 40*c*, 40*d* to meet the foot section 14*b* at a junction 46. The junction 46 extends along a width of the duvet cover 12 about midway between the opposing pair of the side edges 40*c*, 40*d*, and the opening 20 into the pocket 22 is defined between the head and foot sections 14*a*, 14*b* at the junction 46. Likewise, the foot section 14*b* extends from the foot end edge 40*b* and along about half of the length of the opposing pair of side edges 40*c*, 40*d* to the junction 46. As with the bottom or top orientation of the first fabric layer 14, it should be understood here that the orientation of the head and the foot section 14*a*, 14*b* may be reversed by a user in other embodiments without departing from the scope of the invention. That is, a user may desire that the head section 14*a* be at the foot of the bed 30 and the foot section 14*b* be at the head of the bed 30 when the duvet cover 12 is placed atop the bed 30.

As best shown in FIGS. 3-5 and 7, the first fabric layer 14 also includes an overlap section 14*c* that defines a flap that cooperates with the head section 14*a* at junction 46 adjacent opening 20 and extends away therefrom for overlapping engagement with the foot section 14*b* upon assembly of the duvet cover, such as when used in system 10. In one example, the overlap section 14*c* and head section 14*a* may be a continuous piece of fabric. In another example, the overlap section 14*c* may be sewn or stitched to the head section 14*a* by means known in the art. Here, the dimensions of the overlap section 14*c* mimic or essentially mimic those of the foot end section 14*b*. That is, both the length and width of the overlap section 14*c* may be the same as or essentially the same as foot section 14*b*, and by virtue of this embodiment is sized to be of the same length and width of the head end 14*a*. To that end, the overlap section 14*c* can be sized to cover most or all of the opening 20 as well as most or all of the foot section 14*b*. Thus, when the overlap section 14*c* is secured to the foot section 14*b*, as will be described in further detail below, the opening 20 is covered and the top side 50 of the overlap section 14*c* and a bottom side 48 of the foot section 14*b* generally face one another. In addition, a distal edge 47*b* of the flap 14*c* aligns or generally aligns with foot end edge 40*b*, and opposite side edges 47*c* and 47*d* of the flap 14*c* align or generally align with corresponding side edges 40*c*, 40*d* of the foot section 14*b*. It should be understood that the length and/or width of the overlap section 14*c* may be adjusted, as desired, and still be sized to effectively cover the opening 20.

As shown, each of the head section 14*a*, foot section 14*b*, and overlap section 14*c* includes a bottom side 48 that faces downwardly towards the bed 30 when the duvet cover 12 is in use, and a top side 50 that faces in an opposite direction from the respective bottom side 48. Thus, the top side 50 of the first fabric layer 14 and a bottom side 36 of the second fabric layer 16 generally face one another as best shown in the cross-sectional view of FIG. 7. Although not shown, the bottom side of the head section 14*a* and the overlap section 14*c*, like the second fabric layer 16, may include a decorative pattern that adds a desirable or specific aesthetic look when the duvet cover 12 covers the bed 30. The decorative pattern may be the same as, or different from, the pattern on the second fabric layer 16. This may be desired to provide for additional aesthetic options, particularly when the orientation of the first fabric layer 14 is reversed atop the bed 30. The decorative pattern may be applied to the first fabric layer 14 by any known method, including dyeing, printing, and the like. Furthermore, the decorative pattern may define any color and sequence as desired by the end user of the duvet cover 12.

It will be understood that while the junction 46 is centrally located here, the relative sizes of the head section 14*a*, foot section 14*b*, and overlap section 14*c* and the corresponding position of the junction 46 may be modified in other embodiments consistent with the scope of this invention. For example, the head section 14*a* and foot section 14*b* may be sized so that the junction 46 is closer to the head end edge 40*a* or closer to the foot end edge 40*b*, with the overlap section 14*c* appropriately sized to overlap or essentially overlap the corresponding foot section 14*b*. As shown here, the head section 14*a* and the foot section 14*b* define approximately a 50:50 split of the length of the duvet cover 12. In other examples, the split may be 40:60, 30:70, 25:75, 75:25, 70:30; 60:40, and the like, with the overlap section 14*b*, again, appropriately sized to overlap or essentially overlap the corresponding foot section 14*b*. In other embodiments, the junction 46 can be tailored to be spaced from the head end edge 40*a* by no more than a predetermined maximum distance.

The head and foot sections 14*a*, 14*b* are provided as separate pieces of fabric that are connected such as by stitching 39 at the junction 46. The overlap section 14*c* is provided as a continuous piece of fabric that extends from the head section 14*a* so that the overlap section can cover the opening 20 and foot section 14*b*, as discussed above. The opening 20 is specifically located in a central portion 54 of the junction 46 between the stitching 39 extending from the side edges 40*c*, 40*d*. To this end, the opening 20 and central portion 54 are spaced from the opposing pair of side edges 40*c*, 40*d* by the portions of the junction 46 containing the stitching 39. The opening 20 is therefore spaced from all the plurality of side edges on the duvet cover 12 and centrally located to make it easier to insert and remove the large fill layer 18. Furthermore, the opening 20 extends along a majority of the width of the duvet cover 12 as shown in FIGS. 3 and 4. The length of the stitching 39 inwardly can be chosen to be sufficient to establish a definitive solid edge of the pocket 22 defined within the duvet cover 12, such that the fill layer 18 does not tend to dislodge out of the edges of the opening 20 when placed within the duvet cover 12. It will be understood that the length of stitching 39 on opposite ends of the junction 46 relative to the opening 20 may be modified in other embodiments consistent with the scope of this invention.

Although the head and foot sections 14*a*, 14*b* of the first fabric layer 14 are shown as separate pieces of fabric in the Figures, it will be understood that these may be formed from the same piece of fabric as the second fabric layer 16, just folded over into the head and foot sections 14*a*, 14*b* and stitched together at the closed periphery 38 and at the junction 46. In still further embodiments, head and foot sections 14*a*, 14*b* are integrally formed by a unitary piece of fabric material rather than two pieces connected together at the junction 46, in which case the opening 20 would be cut into the unitary piece of fabric material at the junction 46. In such embodiments, the overlap section 14*c* would be a separate fabric piece sewn or stitched to the head section 14*a*. The unitary piece of fabric material of such embodiments may be a folded over same piece as the second fabric layer 16, or it may be a separate piece of fabric material later connected by stitching 39 to the second fabric layer 16. Regardless of the configuration defining the head and foot sections 14*a*, 14*b*, the opening 20 is still advantageously placed to make insertion and removal of the fill layer 18 easy. And the overlap section 14*c* would be sized to cover most or all of the opening 20 as well as most or all of the foot section 14*b*.

As described initially above, the fabric layers 14, 16 and the closed periphery 38 formed by the stitching of these layers together collectively define a pocket 22 sized to receive the fill layer 18 in the form of a full-size blanket or comforter. The pocket 22 can most easily be seen in the partial cross-sectional view of FIG. 7. The pocket 22 is designed such that the first and second fabric layers 14, 16 enclose substantially the entirety of the fill layer 18, which hides the fill layer 18 and avoids having the fill layer 18 contact users of the bed 30 in normal operation. This allows the fill layer 18 to be washed and laundered much less frequently than the duvet cover 12, thereby reducing the workload for using system 10.

As shown most clearly in FIGS. 3-5, the retention slots 24 in this embodiment are provided at the corner portions 26 in the head and foot sections 14*a*, 14*b* as well as the corner portions 26 of the overlap section 14*c*. An additional optional retention slot 24 is situated adjacent the distal edge 47*b* intermediate the corner retention slots 26 in the overlap section 14*c*. The retention slots 24 are similar in construction to reinforced button holes, e.g., they are defined by a slit opening surrounded by reinforcement stitching. The reinforcement stitching can be color-coded to help identify the size of the duvet cover 12 and the bed 30 that the duvet cover 12 is designed to cover, as set forth in further detail below. The slit opening of the retention slot 24 in this embodiment is configured to resiliently or otherwise expand to a size large enough to permit passage of a corresponding fastening element 28 as described further detail below, but then return to a position where the fastening element 28 is compressed at an inner end thereof to retain the fastening element 28 in position. The specific construction and arrangement of the retention slots 24 may be modified to other known designs for retaining various fastening elements 28 in other embodiments of the invention, insofar as this is just one example of what can be used to help retain the overlap section 14*c* in a desired position over both the opening 20 and foot section 14*b* and help retain the fill layer 18 in a desired position within the pocket 22 following assembly of the system 10. For example, the retention slots 24 of the head and foot sections 14*a*, 14*b* in another embodiment consistent with the invention would be placed at the corner portions 26 but in the second fabric layer 16 instead of the first fabric layer 14. Moreover, alternative types of fastening elements such as snaps may be used in other embodiments, while retaining the benefits of securing the components of the duvet cover 12, and the system 10, in position and providing color coding that helps a user readily identify the size of the components after cleaning.

The first and second fabric layers 14, 16 defining the duvet cover 12 can be constructed of various fabrics such as conventional materials that are typically used in the construction of sheets and similar bedding materials. Fabric construction can be woven, non-woven, or knitted. In one example, the fabric construction is a woven plain weave. The fabric can include natural and/or synthetic fibers and may be lint free, as desired. In one example, the fabric includes polyester, polypropylene, and/or cotton. In another example, the fabric is substantially polyester, substantially cotton, or a polyester/cotton blend (e.g., a 50/50 or other specialized mixtures or weaves). The fabric also may incorporate additional elements such as, but not limited to: ESD (electrostatic dissipative)/anti-static yarns, including nylon or carbon fibers, and the like; liquid resistant material, such as polyester or polypropylene; liquid resistant coatings or finishes that conform to at least minimum standards established for Level 1 classification by AAMI PB70 Standard, such as a fluorocarbon based finish; and/or an antimicrobial finish. These additional elements can comprise about 1% of the total material of the duvet cover 12, but may be provided in a greater or lesser amount as desired. The fabrics used for the duvet cover 12 may include some resiliency to help facilitate the easy assembly and disassembly with the fill layer 18. These are but some examples of the materials that can be used to form the duvet cover 12. It will be understood that the fabric layers 14, 16 may be provided in the same material in some embodiments, but the first or second fabric layer 14, 16 may also be provided in a different material that may be more inexpensive, for example, in other embodiments consistent with the scope of this disclosure. To this end, the materials chosen for the duvet cover 12 and its construction can be tailored to meet the needs of various end users in various settings.

Now turning to the fill layer 18, this element is visible at FIGS. 2 and 3. The fill layer 18 is defined by a blanket or comforter 56, which is configured to provide a thickened layer of insulating filler that insulates the bed 30 and persons located under the system 10 from the external environment about the bed 30. In this regard, the fill layer 18 is sandwiched in this embodiment of the system 10 between the fabric layers 14, 16 of the duvet cover 12, with the fill layer 18 also typically defining a larger thickness than either of these other layers. The blanket or comforter 56 includes a peripheral edge 57 that generally matches the shape and size of the closed periphery 38 defined by the duvet cover 12, albeit typically with slightly smaller overall width and length dimensions such that the fill layer 18 can fit within the pocket 22. To this end, the fill layer 18 of the illustrated embodiment has a generally rectangular shape and the peripheral edge 57 thereof includes various side edges similar to the head end edge 40*a*, the foot end edge 40*b*, and the side edges 40*c*, 40*d* of the duvet cover 12. Accordingly, the fill layer 18 when spread out has roughly the same size in plan view as the duvet cover 12, which can be seen in the exploded views of FIGS. 2 and 3.

The blanket or comforter 56 further includes a top surface 58 and a bottom surface 60 each delimited by the peripheral edge 57. The top surface 58 of the blanket or comforter 56 can face towards the second fabric layer 14 when the system 10 is fully assembled, while the bottom surface 60 of the blanket or comforter 56 can face towards the first fabric layer 16 when fully assembled. And the overlap section 14*c* effectively covers the opening 20 into which the fill layer 18 has been received. Advantageously, the fill layer 18 is substantially enclosed around its entirety and effectively hidden from view when the duvet cover 12, such as when used in the system 10, is in normal use, as shown at FIG. 1. In this regard, even when the system 10 is used on the bed 30 without a top sheet of a standard sheet set, the fill layer 18 remains out of contact with any persons located in the bed 30, because of this enclosure of the blanket or comforter 56.

The system 10 of this embodiment includes fastening elements 28 on the fill layer 18 and the foot section 14*b* to interact with the retention slots 24 described above. Those fastening elements 28 may be provided in corner portions 62 of the rectangular-shaped blanket or comforter 56 and the foot section 14*b* as well as adjacent the foot end edge 40*b* intermediate the corner fastening elements 28 of the foot section 14*b*, to thereby match the positions of the retention slots 24.

FIGS. 4-7 illustrate the fastening elements 28 and the retention slots 24 of this embodiment in further detail. In this embodiment, the fastening elements 28 on the fill layer 18 are defined by fabric knot buttons located on the bottom surface 60 of the fill layer 18 and the fastening elements 28 on the foot section 14*b* are defined by standard buttons (e.g., plastic, acrylic, wood, metal, or the like) located on the bottom surface 48 of the foot section 14*b*. It will be understood that in alternative embodiments in which the retention slots 24 are provided in the head and foot sections 14*a*, 14*b*, the fabric knot buttons would be located on the top surface 58 of the fill layer 18 (but the fill layer 18 is typically reversible in orientation before placement in the pocket 22, so the specific side usually does not matter). Also, one or more additional standard buttons on the foot section 14*b* may be provided along the foot end edge 40*b* along with corresponding retention slots 24 on the overlap section 14*c*, as needed/desired to more effectively engage the overlap section 14*c* with the foot section 14*b*. Also, the standard buttons may be replaced with fabric knot buttons, as desired. The fabric knot buttons are highly deformable or compressible to enable insertion and removal through the retention slots 24, which also allows for these elements on the fill layer 18 to go through industrial laundering equipment without being damaged by this equipment, and without causing damage to this equipment. Even though the fill layer 18 does not need to be laundered as often as the duvet cover 12, it is still desirable to make the fill layer 18 capable of such laundering when the need arises for such cleaning. Despite having the ability to deform or compress in laundering equipment, the fabric knot buttons defining the fastening elements 28 are configured to reliably stay retained when inserted through the retention slots 24.

Figure 6A:
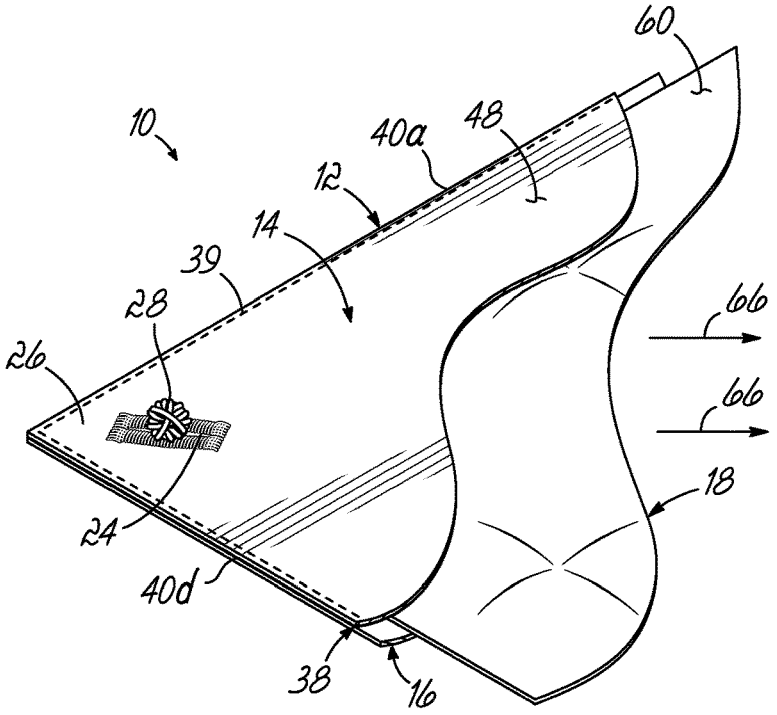
FIG. 6A is a detailed cutaway perspective view of one of the corner portions defined by the central access duvet cover system, as identified in detail block "6" of FIG. 5, with the fill layer and duvet cover engaged to show the coupling of one of the plurality of fastening elements on the fill layer with one of the retention slots of the duvet cover.
Figure 6B:
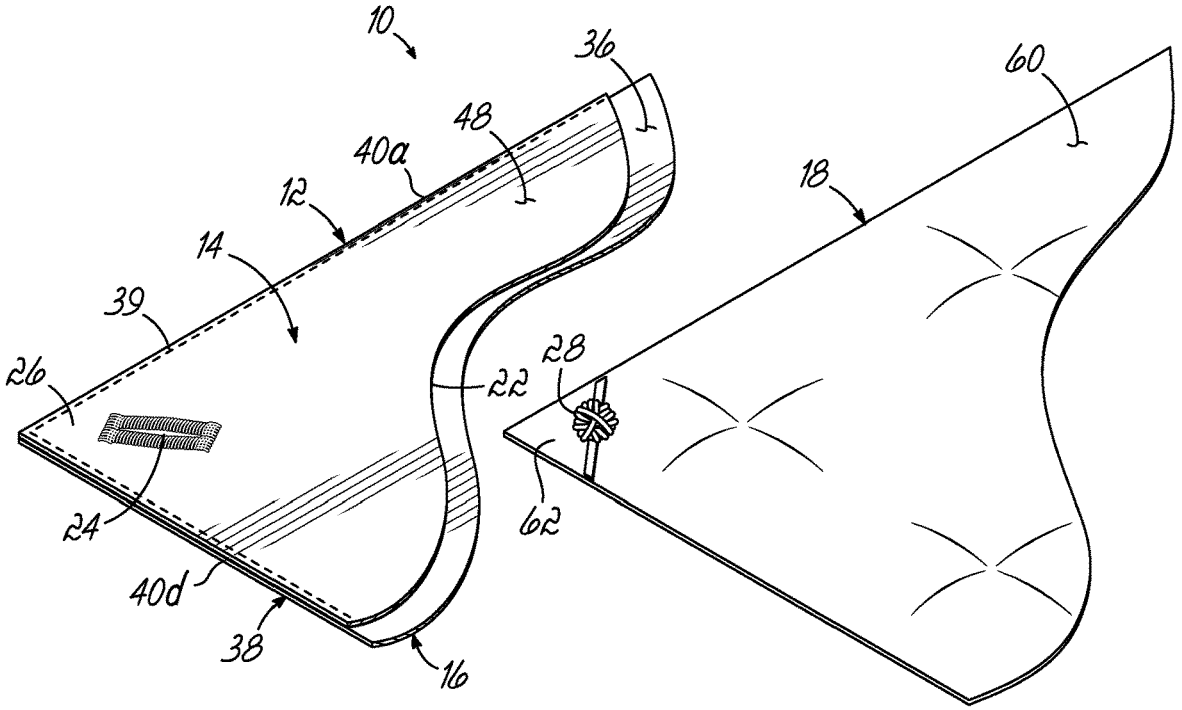
FIG. 6B is a detailed cutaway perspective view of one of the corner portions (like that shown in FIG. 6A) of the central access duvet cover system of FIG. 5, with the fill layer and the duvet cover in a disassembled state.
Figure 7:
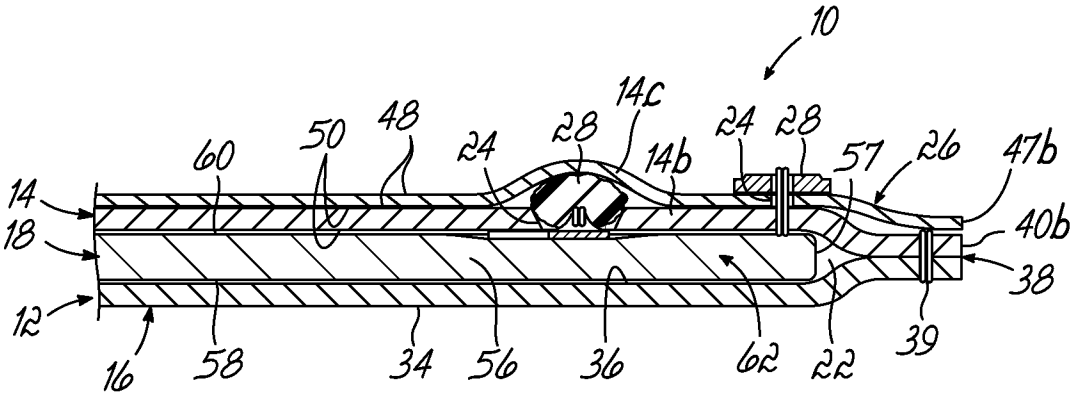
FIG. 7 is a side elevation cross-sectional view through one of the corner portions of the central access duvet cover for use in the central access duvet system of FIG. 5, taken along line 7-7 in FIG. 5, to reveal the pocket enclosing the fill layer, as well as further details of one of the plurality of fastening elements of the fill layer engaged with one of the retention slots of the foot section and one of the fastening elements of the foot section engaged with one of the retention slots on the overlap section.

By putting a plurality of matching pairs of the fabric knot buttons (fastening elements 28) and the retention slots 24 on the fill layer 18 and on the head and foot sections 14*a*, 14*b*, respectively, the system 10 reliably retains the fill layer 18 in a desired location within the pocket 22, and by putting a plurality of matching pairs of the standard buttons (fastening elements 28) and the retention slots 24 on the foot section 14*b* and overlap section 14*c*, respectively, the system 10 reliably covers the opening 20 and overcomes various disadvantages associated with conventional duvet covers, while nevertheless still allowing for easy assembly and disassembly of the system 10. For example, the fill layer 18 is accurately located at each of the corner portions 26 of the duvet cover 12, which thereby prevents unintended shifting, bunching, or folding upon itself by the fill layer 18 within the pocket 22. Also, the opening 20 and foot section 14*b* are effectively covered by way of the overlap section 14*c*, which can reduce the need for a specified orientation of the system atop a bed and also eliminate concerns that the duvet cover 12 itself may interfere with a user's sleep. When it is desired to disassemble the system 10, a user must simply push the respective fastening elements 28 back through the retention slots 24 of the foot section 14*b* and overlap section 14*c* and then pull the overlap section 14*c* away from the foot section 14, then perform the same function with respect to the fastening elements 28 and the retention slots 24 of the corner portions 62 of the fill layer 18 and the corner portions 26 of the head and foot sections 14*a*, 14*b*, as shown by movement arrows 66 in FIG. 6A. The disassembled fill layer 18 and duvet cover 12 are shown at FIG. 6B, for example, and it will be readily understood that the fastening element 28 will not add significant resistance to removal of the fill layer 18 from the pocket 22 at this stage. Advantageously, the duvet cover 12 and the fill layer 18 with these additional components remain cost-efficient to manufacture in such an arrangement as compared to designs that must incorporate zippers or other complex items, which reduces the overall cost of using the system 10.

In the illustrated embodiment shown in FIGS. 4 through 7, the fastening elements 28 are located only at certain positions on the duvet cover 12 and on the fill layer 18, thereby reducing the total number of assembly points needed when assembling the system 10. By securing the fill layer 18 at the corresponding corner portions 62, the fill layer 18 is effectively prevented from dislodgment in any direction. Of course, it will be understood that more or fewer fastening elements 28 and different configurations of positions for the fastening elements 28 may be used in other embodiments consistent with the scope of this disclosure, such as when the shape of the fill layer 18 and/or duvet cover 12 are modified from those shown.

At least some of the fastening elements 28 and the retention slots 24 (which may also be collectively referred to as fastening elements) of this invention may be color-coded such that the material defining the fabric knot and/or standard buttons 28 and the stitching around the retention slots 24 have a readily identifiable color. The color is chosen to correspond to the size of the bed 30 that the duvet cover 12 is designed to cover. For example, the fastening elements provided on the fill layer 18 and the duvet cover 12 of a system 10 sized for a twin-size bed may be red, while the same fastening elements on components for a full-size bed may be blue, queen-size green, king-size gold, and so on. When sorting and matching duvet covers 12 for multiple size beds after washing, the color coding of the fastening elements enables easy size identification and proper matching of fill layers 18 to duvet covers 12. Thus, a user will not waste time manually comparing the size of these elements, or waste time trying to assemble a fill layer 18 and a duvet cover 12 that are not the same size. This significant time savings enables management and use of improved aesthetic bedding materials provided by the duvet cover 12, such as when used in system 10, even if a plurality of different size beds is to be maintained. Further examples of the color coding will be described below with reference to FIGS. 8 through 9C.

It should also be appreciated that any pair of the fabric knot or standard buttons 28 and retention slots 24 may be replaced or interchanged with a different type of fastening element, while still retaining the overall benefits of the duvet cover 12 and system 10. For example, while the fastening elements 28 have been discussed in this embodiment as fabric knot or standard buttons, other types of fastening elements such as hook and loop closures (e.g., VELCRO®), silicone buttons, magnets, and/or other alternatives like ties or clasps may be used in place of some or all the fabric knot or standard buttons, while still retaining the overall benefits of the duvet cover 12 and system 10. Further types of fastening elements such as metallic snaps and buttons could also be used with other embodiments of the duvet cover 12 and system 10. Regardless of the fastening elements chosen, the fastening elements advantageously enable easy and simple separate connection of the duvet cover 12 to the fill layer 18, with the fastening elements still being color-coded to be configured to enable quick size identification for users of the system 10.

When the duvet cover 12, such as when used in the system 10, is assembled, and laid on the bed 30 as shown in FIG.

1, at least some of the fastening elements 28 and retention slots 24 may not be visible, so these elements do not detract from the desirable aesthetic appearance simulating a conventional duvet cover. Even though a pair of these fastening elements 28 may become visible when a user turns down the system 10 along the head end edge 40*a*, these elements are small and are located along the edges of the bed 30, so therefore may go largely unnoticed by the user of the bed 30. In any event, the potential for negative impacts on the aesthetic appearance of the system 10 is minimized thanks to the positioning shown in this embodiment. Consequently, the appearance of a conventional duvet cover is achieved, while defining an assembly of components that is easy and quick to assemble and disassemble, and sort by size, enabling regular cleanings of the duvet cover 12 without significant additional work.

The fill layer 18 may be comprised of similar fabric materials as described above, as well as of various fillers as well known in the art of bedding and blanket materials. If the fill layer 18 is formed independently from the duvet cover 12, and is provided to be removable easily from the remainder of system 10, the specific materials chosen will not affect the principal beneficial functionalities of the duvet cover 12 and system 10, which are discussed throughout this application. For example, the fill layer 18 will avoid most contact with persons and other sources that lead to a need to clean or launder the fill layer 18, which is beneficial for all the reasons set forth above. Furthermore, the fill layer 18 is readily identified in size by the color coding provided on the fastening elements 28, thereby allowing for matching with a corresponding duvet cover 12 before assembling these elements together and placing the system 10 on the bed 30.

Figure 8:
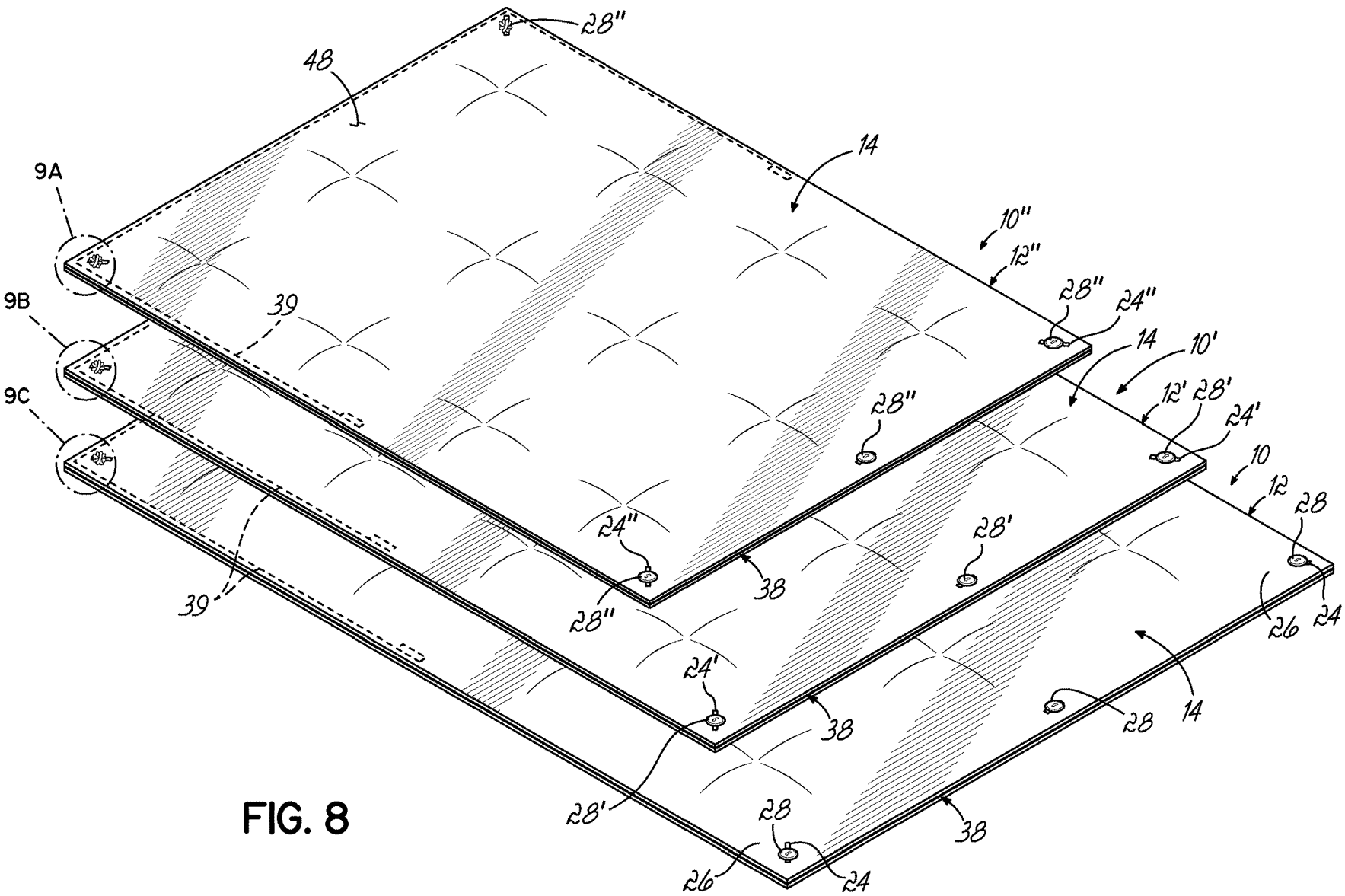
FIG. 8 is a bottom perspective view of a plurality of central access duvet covers for use in central access duvet systems of varying sizes in accordance with the embodiments of the invention, with the fill layer and the duvet cover combined in the fully assembled state and the systems laid out in a completely horizontal orientation.
Figure 9A:
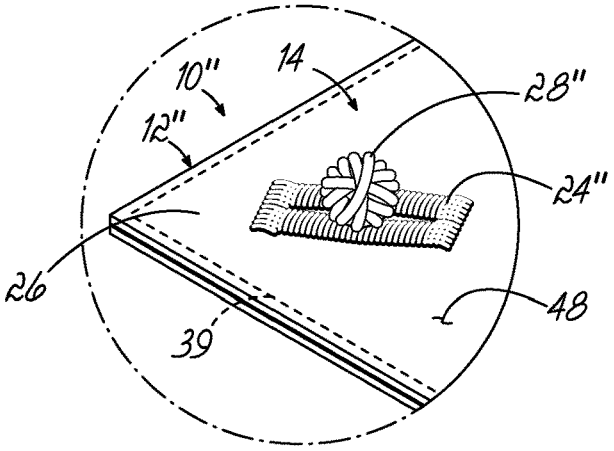
FIG. 9A is a detailed perspective view of one of the corner portions of a first central access duvet cover for use in a first central access duvet system included in the plurality of duvet cover systems in FIG. 8, as identified in detail block "9A" in FIG. 8, showing a first color coding on one of the fastening elements of the fill layer and one of the retention slots of the head section associated with the size of the first central access duvet cover system.
Figure 9B:
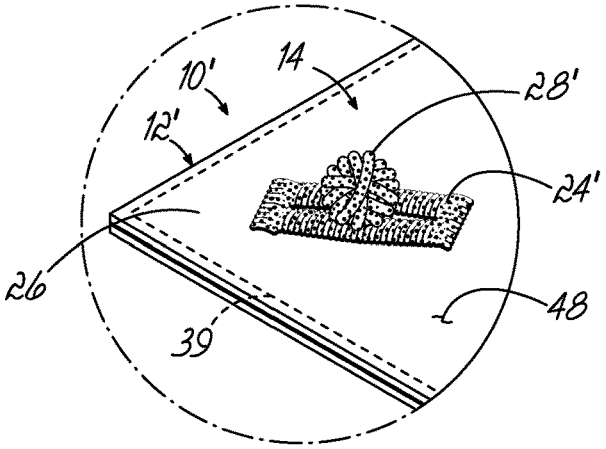
FIG. 9B is a detailed perspective view of one of the corner portions of a second central access duvet cover for use in a second central access duvet system included in the plurality of central access duvet cover systems in FIG. 8, as identified in detail block "9B" in FIG. 8, showing a second color coding on one of the fastening elements of the fill layer and one of the retention slots of the head section associated with the size of the second central access duvet cover system.
Figure 9C:
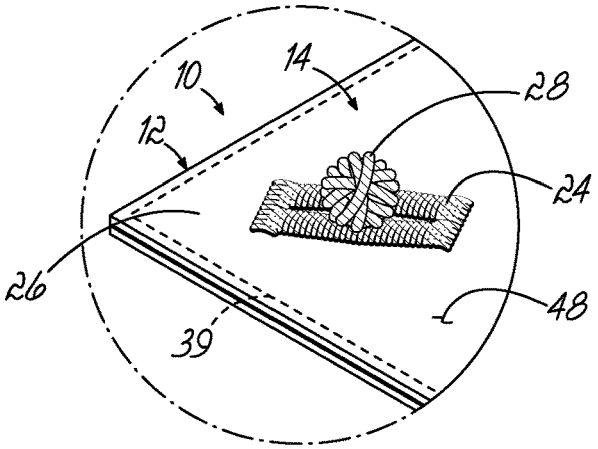
FIG. 9C is a detailed perspective view of one of the corner portions of a third central access duvet cover for use in a third central access duvet system included in the plurality of central access duvet cover systems in FIG. 8, as identified in detail block "9C" in FIG. 8, showing a third color coding on one of the fastening elements of the fill layer and one of the retention slots of the head section associated with the size of the third central access duvet cover system.

With reference to FIGS. 8 through 9C, various sizes of the duvet cover 12 for use in the system 10 in accordance with the embodiment described in detail above are shown schematically laid out in a horizontal orientation on top of each other. For example, the duvet cover 12 when used in system 10 at the bottom level of FIG. 8 may be sized to cover a "California king" bed (typically defined by a 72×84-inch size), while the duvet cover 12' for use in system 10' shown directly above that in FIG. 8 may be sized to cover a queen-size bed (typically defined by a 60×80-inch size), and the duvet cover 12" for use in system 10" shown at the top level of FIG. 8 may be sized to cover a twin-size bed (typically defined by a 39×75-inch size). For each of these standard bed sizes, the width and length of the mattress and support structure varies, and the duvet cover system 10, 10', 10" with duvet cover 12, 12', 12" also should be varied in size to cover these different dimensions. It will be understood that while the examples of standard bed sizes above are used in Canada and the United States, other standard bed sizes in other countries may also use the color-coded fastening elements for size identification as described herein, as this is just one example illustrating the general concept. Although the difference in size between the systems 10, 10', 10" shown in FIG. 8 may be clear when fully laid out horizontally, it is difficult, if not impossible, to evaluate the size difference when not in this orientation because the systems 10, 10', 10" are otherwise identical in components and structure. Furthermore, some standard bed sizes like king and queen have the same length and somewhat similar widths (the same can be said of full and twin size beds), and differentiating between these different sizes is even more difficult. Therefore, it can be difficult when cleaning and sorting a plurality of duvet covers 12 to match those to corresponding sizes of fill layers 18 after the cleaning process.

However, the duvet covers 12, 12', 12" for use in systems 10, 10', 10" of the invention address this difficulty by providing color coding to the fastening elements used to secure the components of the systems 10, 10', 10" in place relative to one another. Using the example provided above, which FIGS. 8 through 9C are consistent with, the fastening elements are defined by fabric knot or standard buttons 28 and retention slots 24 with stitching around the retention slots 24. As shown in the detail corner views of FIGS. 9A, 9B, and 9C, the color of these fastening elements matches when the fill layer 18 is the same size as the duvet cover 12. Thus, a duvet cover 12" for use in system 10" designed to cover a first size of bed such as twin-size may include a first color (e.g., red) on the fabric knot buttons 28" and the retention slots 24" as shown in FIG. 9A. By contrast, a duvet cover 12' for use in system 10' designed to cover a second size of bed such as queen-size may include a second color (e.g., green) on the fabric knot buttons 28' and the retention slots 24' as shown in FIG. 9B by the dotted cross-hatching on these elements. A duvet cover 12 for use in system 10 designed to cover a third size of bed such as California king-size may include a third color (e.g., purple) on the fabric knot buttons 28 and the retention slots 24 as shown in FIG. 9C by the striped cross-hatching on these elements. A specific color can be assigned for each standard bed size in a country or region, thereby enabling different duvet covers 12 and fill layers 18 to be mixed and used together (assuming all include the color-coded fastening elements).

It will be understood that in some embodiments, all the fastening elements on the fill layer 18 and the duvet cover 12 are color-coded, while in other embodiments, only a partial subset of the fastening elements may be color-coded without departing from the scope of this invention. For example, only the fastening elements located along the foot end edge 40*b* may be color-coded, while the other fastening elements are not colored in the same manner. Advantageously, the color coding enables easy size identification of the elements of a duvet cover system 10 without requiring additional costs/steps and without affecting the desirable aesthetic appearance provided by the system 10. To this end, by applying dye or otherwise forming the fastening elements of a colored material corresponding to the size of the bed 30 that the system 10 is to cover, these elements that must already be manufactured to provide a reliable retention of the fill layer 18 in position and overlap and cover the opening 20 and foot section 14*b* serve a second purpose of size identification as well. There is no requirement for further added tags or other elements, or complex/expensive additional steps of manufacture to provide the color coding at the fastening elements. The small size of these fastening elements does not significantly detract from the desirable aesthetic appearance of the system 10, particularly when laid out on a bed 30 as shown in FIG. 1. In this regard, the color coding of this invention does not necessitate application of color across all or a substantial portion of the fabric material defining the duvet cover 12 (and the fill layer 18), and that allows for the desirable aesthetic appearance of the duvet cover 12 for use in system 10 to be unaffected by this invention.

Thus, it can readily be appreciated that the assembly of the system 10 can be quickly accomplished to positively secure the fill layer 18 in an enclosed position sandwiched between fabric sheets of the duvet cover 12 and to effectively cover the opening 20 that receives the fill layer 18 by positively securing the overlap section 14*c* to the foot section 14*b*. The fabric knot and standard buttons 28 and retention slots 24 used as fastening elements prevent unintended shifting of the fill layer 18 within the pocket 22, while also providing color coding to allow for quick size identification of these elements relative to bed size. In addition, the need to specifically orient the duvet cover 12 atop a bed is reduced or eliminated along with reducing concerns that the opening 20 itself may interfere with a user's sleep. Also, the duvet cover 12 is easily removable and replaceable for cleaning and other purposes, and the duvet cover 12 in normal use hides the appearance of the opening 20 into the pocket 22, to provide the desirable appearance of a conventionally-constructed duvet cover. The color coding of the fastening elements does not detract from this desirable aesthetic appearance. However, the color coding does allow for rapid sorting and matching of same-size pairs of fill layer 18 and duvet cover 12, even when many systems 10 are to be cleaned daily for multiple sizes of beds 30. Furthermore, the relatively simple construction of the duvet cover 12 provides a lower cost for the system 10.

While the present invention has been illustrated by a description of various embodiments and while these embodiments have been described in considerable detail, it is not the intention of the applicant to restrict or in any way limit the scope of the appended claims to such detail. Additional advantages and modifications will readily appear to those skilled in the art. Thus, the invention in its broader aspects is therefore not limited to the specific details, representative apparatus and method and illustrative example shown and described. Accordingly, departures may be made from such details without departing from the spirit or scope of applicant's general inventive concept.

What is claimed is:

1. A duvet cover comprising:

a first fabric layer and a second fabric layer configured to substantially enclose a pocket between the fabric layers, wherein the first fabric layer is secured to the second fabric layer along each of a plurality of side edges to provide a closed periphery surrounding the pocket, the first fabric layer includes a head section and foot section extending over different portions of the duvet cover and having an opening therebetween defining an entrance to the pocket, the first fabric layer further including an overlap section that defines a flap that connects to a selected one of the head or foot section adjacent the opening and extends in a direction away therefrom, wherein the pocket is configured to receive a fill layer inserted via the opening and the overlap section is configured to cover the opening and overlap with the other of the head or foot section, wherein when the overlap section is moved to cover the opening and overlap with the other of the head or foot section, the duvet cover along one end has two layers overlapping each other with the second fabric layer on an opposite side of the pocket from the selected one of the head or foot section of the first fabric layer, and the duvet cover along another end has three layers overlapping each other with the second fabric layer on an opposite side of the pocket from the overlap section and the other of the head or foot section.

2. The duvet cover of claim 1 wherein the foot and head sections of the first fabric layer meeting one another at a junction, which extends along a width of the duvet cover and between an opposing pair of the side edges;

the pocket is defined between the first and second fabric layers and within the closed periphery, the pocket is sized to receive the fill layer in the form of a blanket or comforter to enclose the fill layer within the duvet cover; and the opening is formed between the foot and head sections of the first fabric layer at the junction to provide access to the pocket from outside the duvet cover, the opening extending along a majority of the width of the cover assembly to enable insertion and removal of the fill layer into and out of the pocket through the opening.

3. The duvet cover of claim 1 wherein the head section and foot section of the first fabric layer each extend over a half of the duvet cover such that the opening is located at a longitudinal center of the duvet cover.

4. The duvet cover of claim 1 wherein the head section and foot section are sized so that the opening is closer to a head end edge or closer to a foot end edge of the duvet cover, with the overlap section appropriately sized to overlap the corresponding head or foot section.

5. The duvet cover of claim 1 wherein the overlap section is configured to overlap and engage with the other of the head or foot section.

6. The duvet cover of claim 1 wherein a distal edge of the flap aligns with a head or foot end edge of the other of the head or foot section, and opposite side edges of the flap align with corresponding side edges of the other of the head or foot section when the overlap section covers the opening and overlaps with the other of the head or foot section.

7. The duvet cover of claim 1 further comprising a plurality of retention slots located at corner portions of the overlap section, the retention slots on the overlap section configured to engage with fastening elements located on the other of the head or foot section.

8. The duvet cover of claim 7 wherein the fastening elements located on the other of the head or foot section are color-coded to help identify the size of the duvet cover and a bed on which the duvet cover is designed to be used.

9. The duvet cover of claim 1 further comprising a plurality of retention slots located at corner portions of the head section, foot section, and overlap section, the retention slots on the head section and foot section configured to engage with corresponding fastening elements located on the fill layer and retention slots on the overlap section configured to engage with fastening elements located on the other of the head or foot section.

10. The duvet cover of claim 9 further comprising an optional retention slot that is situated adjacent a distal edge intermediate the corner retention slots in the overlap section.

11. The duvet cover of claim 9 wherein one or more retention slots are defined by a slit opening surrounded by reinforcement stitching with the reinforcement stitching being color-coded to help identify the size of the duvet cover and a bed on which the duvet cover is designed to be used.

12. The duvet cover of claim 9 wherein at least one or more retention slots and one or more fastening elements on the duvet cover are color-coded to help identify the size of the duvet cover and a bed on which the duvet cover is designed to be used.

13. The duvet cover of claim 1 wherein the first fabric layer comprises a decorative pattern for covering the bed.

14. The duvet cover of claim 1 wherein the second fabric layer comprises a decorative pattern for covering the bed.

15. The duvet cover of claim 1 wherein the first fabric layer comprises a decorative pattern for covering the bed and the second fabric layer comprises a different decorative pattern for covering the bed.

16. The duvet cover of claim 1 wherein the first fabric layer and second fabric layer are integrally formed by a single, unitary piece of fabric material.

17. The duvet cover of claim 1 wherein the overlap section and the selected one of the head or foot section are a continuous piece of fabric.

18. The duvet cover of claim 1 wherein the overlap section is sized to cover most or all of the opening and/or most or all of the other of the head or foot section.

19. A duvet cover system comprising:

a duvet cover having a first fabric layer and a second fabric layer that are configured to substantially enclose a pocket between the fabric layers, the first fabric layer includes a head section and foot section having an opening therebetween defining an entrance to the pocket, the first fabric layer further including an overlap section that defines a flap that cooperates with one of the head or foot section adjacent the opening and extends in a direction away therefrom; and a fill layer, which includes at least one of a blanket or a comforter, and which is configured for insertion within the pocket of the duvet cover, wherein the overlap section covers the opening and overlaps with the other of the head or foot section to hide the opening and fill layer when the duvet cover system is assembled.

20. The duvet cover system of claim 19 further comprising a plurality of fastening elements that are located adjacent corner portions of the other of the head or foot section, which are configured to be engaged with retention slots on the overlap section when the overlap section covers the opening and overlaps with the other of the head or foot section.

21. The duvet cover system of claim 19 further comprising a plurality of fastening elements that are located adjacent corner portions of the fill layer and adjacent corner portions of the other of the head or foot section, the fastening elements on the corner portions of the fill layer configured to be engaged with retention slots of the head and foot sections of the duvet cover when the fill layer is inserted into the opening of the duvet cover and the fastening elements on the corner portions of the other of the head or foot section are configured to be engaged with retention slots on the overlap section when the overlap section covers the opening and overlaps the other of the head or foot section.

22. The duvet cover system of claim 21 wherein at least some of the fastening elements are color-coded based on a size of the bed that the duvet cover system is to cover, such that a user can identify and match the duvet cover to the fill layer to assure that these components are the same size before inserting the fill layer into the pocket.

23. The duvet cover system of claim 19 wherein the head section and foot section of the first fabric layer each extend over a half of the duvet cover such that the opening is located at a longitudinal center of the duvet cover.

24. The duvet cover system of claim 19 wherein the overlap section is configured to overlap and engage with the other of the head or foot section.

25. The duvet cover system of claim 19 further comprising a plurality of retention slots located at corner portions of the overlap section, the retention slots on the overlap section configured to engage with fastening elements located on the other of the head or foot section.

26. The duvet cover system of claim 25 wherein the fastening elements located on the other of the head or foot section are color-coded to help identify the size of the duvet cover and a bed on which the duvet cover is designed to be used.

27. The duvet cover system of claim 19 further comprising a plurality of retention slots located at corner portions of the head section, foot section, and overlap section, the retention slots on the head section and foot section configured to engage with corresponding fastening elements located on the fill layer and retention slots on the overlap section configured to engage with fastening elements located on the other of the head or foot section.

28. The duvet cover system of claim 27 wherein one or more retention slots are defined by a slit opening surrounded by reinforcement stitching with the reinforcement stitching being color-coded to help identify the size of the duvet cover and a bed on which the duvet cover is designed to be used.

29. The duvet cover of claim 27 wherein at least one or more retention slots and one or more fastening elements on the duvet cover are color-coded to help identify the size of the duvet cover and a bed on which the duvet cover is designed to be used.

30. A method for covering a bed with a duvet cover system including a fill layer that is defined by at least one of a blanket or a comforter, comprising:

inserting the fill layer through an opening defined in a duvet cover having a first fabric layer and a second fabric layer secured to one another along each of a plurality of side edges to provide a closed periphery surrounding a pocket enclosed between the fabric layers, the first fabric layer includes a head section and foot section extending over different portions of the duvet cover and having the opening therebetween defining an entrance to the pocket, the first fabric layer further including an overlap section that defines a flap that connects to a selected one of the head or foot section adjacent the opening and extends in a direction away therefrom, wherein the pocket is configured to receive the fill layer inserted via the opening and the overlap section is configured to cover the opening and overlap with the other of the head or foot section;

placing the fill layer into the pocket defined between the first and second fabric layers so as to retain the fill layer between the top and bottom fabric layers of the cover duvet;

coupling a plurality of fastening elements located adjacent corner portions of the fill layer with retention slots located at corner portions of the foot and head sections of the first fabric layer to hold the fill layer in a desired position within the pocket of the duvet cover;

folding the flap defined by the overlap section over the other of the head or foot section to cover the opening, thereby resulting in the duvet cover along one end having two layers overlapping each other with the second fabric layer on an opposite side of the pocket from the selected one of the head or foot section of the first fabric layer, and the duvet cover along another end having three layers overlapping each other with the second fabric layer on an opposite side of the pocket from the overlap section and the other of the head or foot section;

coupling some of the plurality of fastening elements located adjacent corner portions of the fill layer with retention slots located at corner portions of the overlap section to hold the overlap section in position covering the opening and the other of the head or foot section; and laying the duvet cover system onto the bed with one of the first or second fabric layers facing upwardly, the fill layer remaining hidden from view, wherein the duvet cover is configured to be removed for cleaning separate from the fill layer.

* * * * *